US006135877A

United States Patent [19]

Lind

[11] Patent Number: 6,135,877

[45] Date of Patent: Oct. 24, 2000

[54] BOX- OR SCREEN-LIKE SUPPLY AIR TERMINAL DEVICE AND A NOZZLE MODULE OR NOZZLE UNIT THEREFOR

[76] Inventor: Leif Lind, Burevageo 5, S-182 63 Djursholm, Sweden

[21] Appl. No.: 09/125,446

[22] PCT Filed: Mar. 6, 1997

[86] PCT No.: PCT/SE97/00388

§ 371 Date: Aug. 19, 1998

§ 102(e) Date: Aug. 19, 1998

[87] PCT Pub. No.: WO97/34113

PCT Pub. Date: Sep. 18, 1997

[30] Foreign Application Priority Data

Mar. 11, 1996 [SE] Sweden ..... 9600939

[51] Int. Cl.[7] ..... F24F 13/068

[52] U.S. Cl. ..... 454/284; 454/297; 454/299; 454/305; 454/306

[58] Field of Search ..... 454/284, 296, 454/297, 299, 305, 306

[56] References Cited

U.S. PATENT DOCUMENTS

| | | | |
|---|---|---|---|
| 3,319,558 | 5/1967 | Bodian | 454/296 |
| 4,316,407 | 2/1982 | Lambert . | |

FOREIGN PATENT DOCUMENTS

| | | | |
|---|---|---|---|
| 337 972 | 10/1989 | European Pat. Off. . | |
| 337971 | 10/1989 | European Pat. Off. . | |
| 442 856 | 8/1991 | European Pat. Off. . | |
| 96799 | 5/1996 | Finland . | |
| 1169187 | 12/1958 | France | 454/306 |
| 40 26 529 | 2/1992 | Germany . | |
| 42 22 064 | 1/1993 | Germany . | |
| 44 28 655 | 10/1995 | Germany . | |
| 877255 | 10/1981 | U.S.S.R. | 454/284 |
| 1078208 | 3/1984 | U.S.S.R. | 454/296 |
| 1153205 | 4/1985 | U.S.S.R. | 454/296 |
| WO 89/03961 | 5/1989 | WIPO . | |
| WO 90/02912 | 3/1990 | WIPO | 454/284 |
| WO 91/16580 | 10/1991 | WIPO . | |

*Primary Examiner*—Harold Joyce

*Attorney, Agent, or Firm*—Sughrue, Mion, Zinn, Macpeak & Seas, PLLC

[57] ABSTRACT

A supply air terminal device (1) of box-like or screen-like construction has a front wall (5) in which there are disposed a plurality of groups (10) of slots (7) with the groups and the slots in each group mutually spaced apart. Each group of slots is allocated a nozzle module (11) mounted on the inside of the wall (5). Each nozzle module (11) includes a number of nozzles (12) corresponding to the number of slots, wherein each nozzle functions to repeatedly deflect the part-flows (B) through an angle of 90° from a delivered main flow. To this end, each nozzle (12) of a nozzle module (11) carries at its ends curved deflecting parts (12*b*) which project progressively further out in the direction of the main flow. The deflected part-flows mutually collide and exit with a low impulse through the slots (7) allocated to respective nozzles (12). The invention also relates to a nozzle module for a supply air terminal device (1) of the aforesaid kind.

11 Claims, 3 Drawing Sheets

BOX- OR SCREEN-LIKE SUPPLY AIR TERMINAL DEVICE AND A NOZZLE MODULE OR NOZZLE UNIT THEREFOR

FIELD OF INVENTION

According to one aspect, the present invention relates to a box-like or screen-like supply air terminal device of the kind defined more specifically in the preamble of claim 1.

According to another aspect, the invention relates to a nozzle module for use with such a supply air terminal device.

Supply air terminal devices of this kind, for instance those devices marketed under the trademark REPUS®, find versatile use for draught-free delivery of temperature controlled air to different types of work places, for instance offices, and to dwellings. The air delivered by the device has a low impulse and the device can therefore be placed in the immediate vicinity of a work place in many cases and in this way ensure a considerably better quality of air at the work place than would otherwise be the case.

When cold fresh air is delivered to supply air terminal devices of this kind, air is also taken from the occupied zone in the room or place in which the device is placed and preferably mixed with the cold air in suitable proportions, so as to avoid cold draughts on the floor of the room.

DESCRIPTION OF THE BACKGROUND ART

Examples of known supply air terminal devices of this kind are described in SE-B-7613876-7, SE-B-77043362-8, SE-B-7810734-9, U.S. Pat. No. 4,537,118 and EP-A-0 337 971, all in the name of Lind.

Other known solutions utilize air distribution filters which produce a laminar inflow. However, such solutions do not result in satisfactory admixture with surrounding air. The filters also become clogged and must be replaced at regular intervals. Such solutions are therefore both complicated and expensive.

Other examples of the earlier standpoint of techniques are found in WO 90/02912 (Papula Rein Lathela), DE-C-4 428 655 (Erwin Müller) and in DE-C-4 026 529 (H. Kranlz-TKT)

OBJECTS OF THE INVENTION

One object of the invention is to provide an improved supply air terminal device which, without the use of filters, enables room air to be admixed effectively with cold air and which delivers temperature controlled air to the room in an effective and draught-free fashion.

Another object of the invention is to provide a compact supply air terminal device which, according to one preferred embodiment, enables the direction in which the air leaves the device to be adapted individually in a simple fashion.

A further object of the invention is to provide a supply air terminal device with which air exiting from the nozzle openings of the device is distributed more uniformly than in the case of hitherto known supply air terminal devices.

According to a second aspect of the invention, one object is to provide a nozzle module for a supply air terminal device of the aforesaid kind that is separate from the main part of the terminal device and which can be easily fitted thereto. Another object is to provide a nozzle module that can be mass-produced in large numbers and which, in the case of one preferred embodiment, enables the air exiting from the terminal device to be readily controlled within wide limits.

SUMMARY OF THE INVENTION

These and other objects are fulfilled with an inventive supply air terminal device of the aforementioned kind and having the characteristic features set forth in the characterizing clause of claim 1.

The advantages afforded by the invention are governed by the nozzle modules that are located immediately behind the slot-like apertures and that by virtue of their design capture equally as large part-flows to each slot-like aperture. These part-flows are deflected through about 90° two times before passing each slot-like aperture and effective admixture of the fresh air delivered via the supply air terminal device is with room air is achieved effectively by virtue of the configuration and positioning of these slots-like apertures.

Because each group of slot-like apertures is allocated to a particular nozzle module, both the manufacture of the terminal device and fitting of the nozzle module are simplified. One preferred embodiment of the invention also enables the flow of air departing from each group of slots in the device to be adjusted and controlled separately.

Because the part-flows that are deflected by the guide vanes collide prior to their passage through the slots, the part-flows will exit with a low impulse and therewith ensure the desired draught-free delivery.

It is preferred in practice that the nozzle module fitted to the supply air terminal device will have the characteristic features set forth in claim 2. In this embodiment, a controlled part-flow passes through each slot, this part-flow being equally as large with respect to all slots.

It is also preferred that there is provided between two mutually sequential nozzles in a nozzle module a partition wall which contributes towards directing the mutually collided part-flows out through an adjacent slot at right angles to the slot-containing wall.

It is preferred in practice that the nozzle modules are movable in the longitudinal direction of the slots. More specifically, it is preferred that the nozzle modules can be moved from a central position in directions towards both ends of the slots, so that the air streams will be directed at an angle of about ±90° relative to the direction of air flow in the central position of said modules.

Thus, when a nozzle module is moved to one end position, the air streams on this side of the module will be throttled and the air streams on the other side will increase. The air streams are herewith deflected to the throttled side of the module. The ability to move the modules in this way enables the air streams exiting from the terminal device to be directed continuously at an angle of about ±90°.

The slot-like openings therewith enable the air to be directed within given large areas. No correspondence is found in nozzles that have round holes or supply air terminal devices that include nozzles with which the air is guided essentially in dependence on the plate thickness of the device in relation to the diameter of the holes provided. It is also preferred that the ends of the nozzle modules will be provided in practice with spring snap-elements by means of which the modules can be detachably fitted to, or "snapped on" the defining walls of the first and the last slot respectively in a group. This enables the nozzle modules to be easily removed, for instance for recovery or for exchange purposes. The snap-elements may include finger-operable parts that can be actuated when laterally displacing the nozzle modules to adjust the desired outflow direction.

Manoeuvering of the nozzle modules can be facilitated with the aid of several mutually sequential groups of modules that are mutually joined, e.g. by plates that extend on the sides of the modules, so as to enable several modules to be moved laterally at one and the same time.

The number of slots in each group and the dimensions of said slots may be varied within relatively wide limits. With the intention of creating a standard, particularly for facilitating manufacture of the nozzle modules, different type sizes can be determined for different areas of use.

One type size that has been found suitable in the present context is a size that includes twelve slots in each group with each slot measuring 3×35 mm.

The shape of the supply air terminal device per se may also vary within wide limits. For instance, the device may be entirely or partially round, having the form of a box that includes planar and/or curved side surfaces. The cross-sectional shape of the device may also vary within wide limits. Alternatively, the terminal device may have the form of a comparatively compact screen, wherewith the even distribution of air and effective deflection of the air afforded by the invention contributes beneficially to the compact construction of the device.

According to a second aspect, the invention also relates to a nozzle module for a supply air terminal device of the aforedescribed kind, said module having the characteristic features set forth in claim 9.

The main body of the nozzle module may include a rear wall that preferably comprises two parts which protect out at angles to one another in front of the side elements.

A nozzle module of this kind may be located within the terminal device itself, so that the nozzles will essentially be invisible from outside the device, therewith providing an aesthetic advantage. Another advantage is the acoustic effect generated by the labyrinth construction of the module, which reduces direct radiation of sound from the ventilation system.

So that the invention will be more readily understood and further features and advantages of an inventive supply air terminal device and inventive nozzle module made more apparent, the invention will now be described with reference to a number of exemplifying embodiments thereof and also with reference to the accompanying drawings.

DETAILED DESCRIPTION OF PREFERRED EMBODIMENTS

Figure 1:
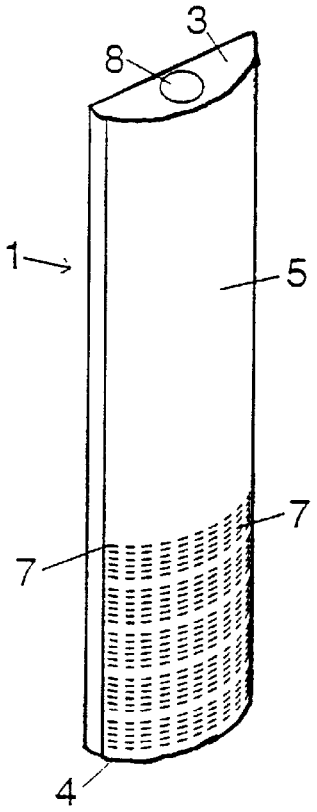
FIGS. 1–4 are perspective views of a number of different types of inventive supply air terminal devices in which the front wall includes a number of groups of slots.
Figure 2:
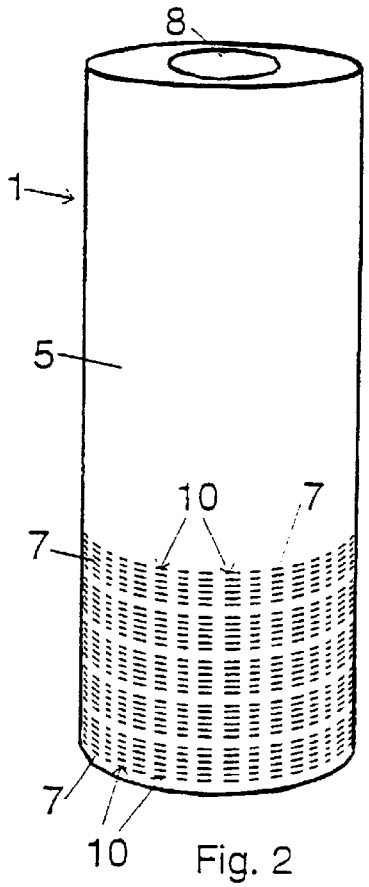
Figure 3:
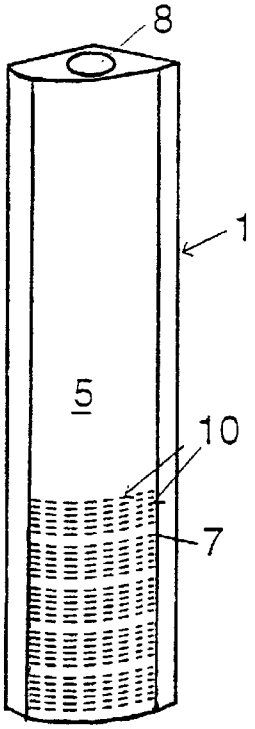

FIGS. 1–3 illustrate examples of a box-like supply air terminal device 1, wherein FIG. 1 illustrates a box having a planar rear wall, planar narrow side walls and a curved front wall, such that the box has in cross-section approximately the shape of the sector of a circle.

FIG. 2 illustrates a box having curved front and rear walls and a generally elliptical shape in cross-section.

FIG. 3 illustrates an example of a box that has in cross-section a generally circle-sector shape and a curved front wall.

Figure 4:
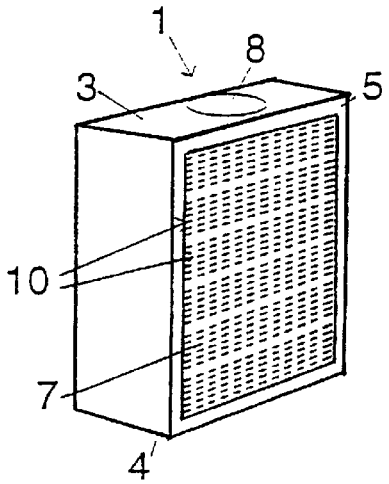

FIG. 4 illustrates an example of a supply air terminal device in the form of a parallelepipedic screen with planar walls.

All of the illustrated supply air terminal devices include a main body that has a top wall 3, a bottom wall 4 and a front wall 5 that includes a plurality of holes or apertures 7 through which air delivered to the interior of the device via a connection 8 is supplied to a room or similar area.

In all of the embodiments illustrated in FIGS. 1–4, the air delivered to the terminal devices flows mainly vertically downwards therethrough.

However, an inventive supply air terminal device need not be placed upstanding on a supporting surface, but may be provided with a horizontal axis such that the main flow direction of the air delivered to the device will be horizontal.

The front wall 5 of all terminal devices shown in FIGS. 1–4 includes a number of groups 10 of slot-like apertures 7, wherein the slots 7 in each group are disposed mutually sequentially in parallel with the main flow direction. Each group 10 is spaced from an adjacent group in both said parallel direction and in a direction perpendicular thereto.

In the case of the terminal devices illustrated in FIGS. 1–4, each group 10 contains six slots 7.

Figure 5:
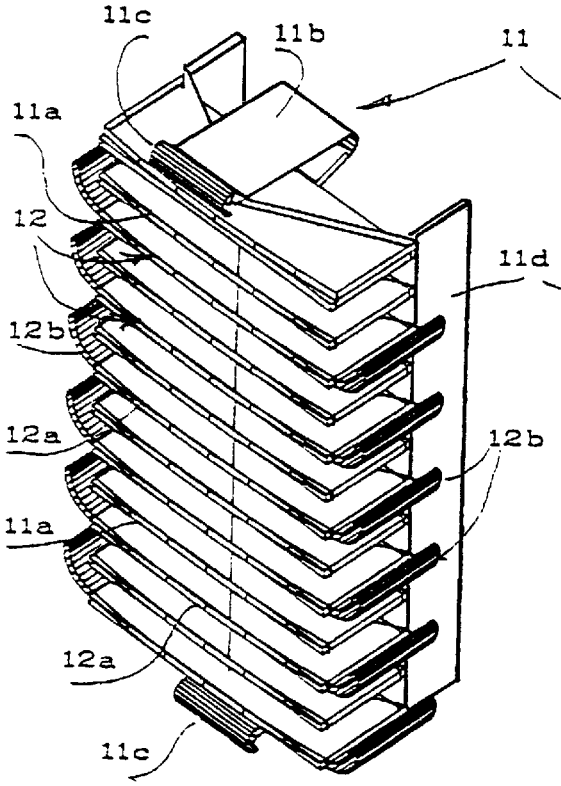
FIG. 5 is a perspective front view of a nozzle module for a supply air terminal device constructed in accordance with the invention.
Figure 6:
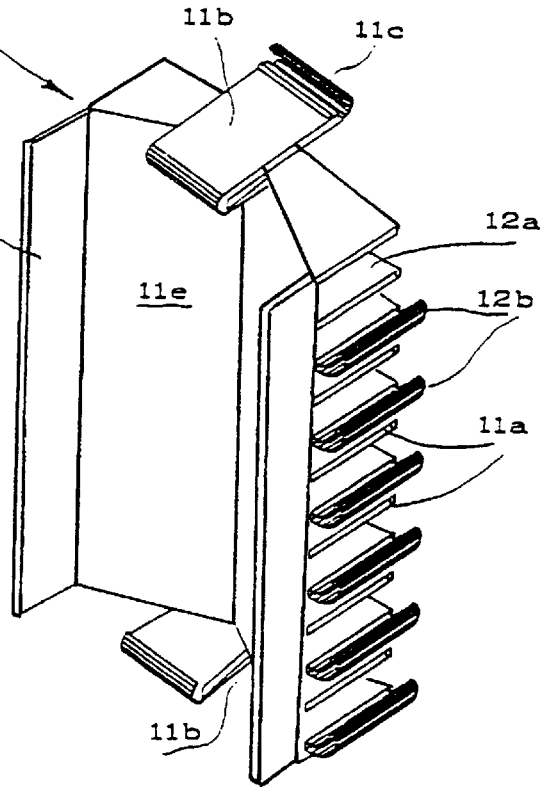
FIG. 6 is a perspective rear view of the nozzle module shown in FIG. 5.

Each group 10 of slots 7 is allocated to a nozzle module 11 of the kind illustrated in FIGS. 5 and 6, said module being mounted on the inner surface of the wall 5. Each nozzle module 11 has a number of nozzles 12 corresponding to the number of slots, in other words six nozzles 12 in the illustrated case.

Figure 7:
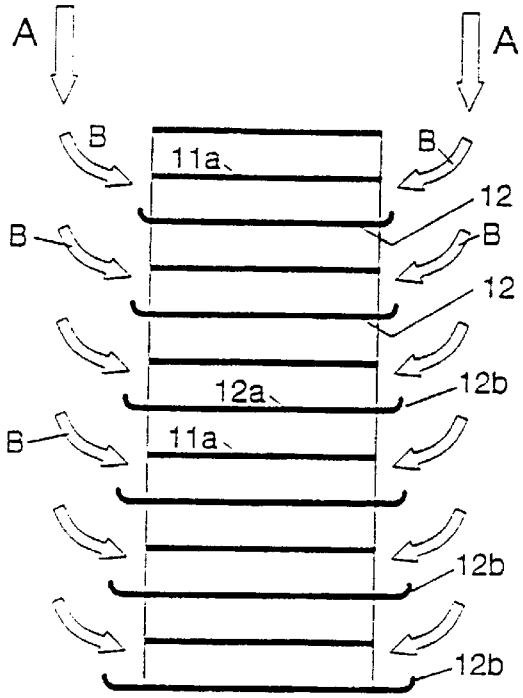
FIG. 7 is a front view of the nozzle module shown in FIGS. 5 and 6 and shows deflection of the main flow and the part-flows.

As will be evident from FIGS. 5–7, the area of the mutually sequential nozzles 12 of a nozzle module 11 seen at right angles to the main flow direction A increases progressively, i.e. have curved deflecting parts 12*b* that project progressively outwards along the length of said parts.

These curved deflecting parts 12*b* are disposed at the ends of the central, planar main part 12*a* of respective nozzles. The curved deflecting parts may alternatively, or in addition, have a width which increases progressively in a direction perpendicular to the plane of the paper in FIG. 7.

As a result of this configuration, each nozzle 12 of a nozzle module 11 is able to capture and repeatedly deflect the part-flows B from a main flow A, namely first from the main flow direction perpendicularly thereto and in towards the centre of the nozzle, and thereafter further deflect the part-flows through an angle of 90°—in the illustrated case horizontally outwards through respective slots 7—due to collision of the deflected part-flows B in each nozzle. As evident from FIG. 8, the part-flows then exit with a low impulse through the slot 7 that coacts with said nozzle.

Figure 8:
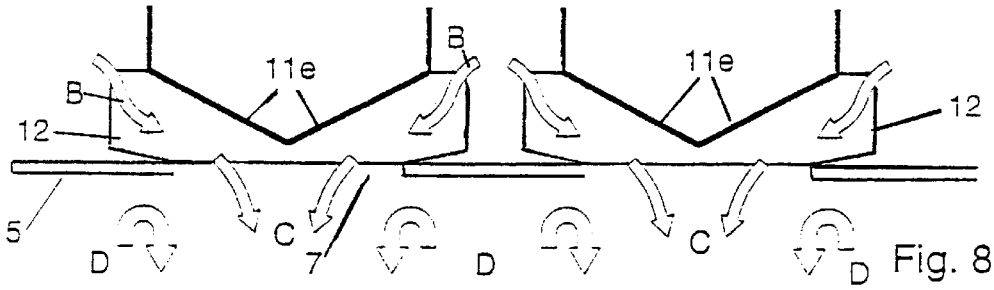
FIG. 8 is a view from above of two mutually adjacent slots with associated nozzles that form parts of a nozzle module according to FIGS. 5–7, and illustrates the collision of part-flows deflected in respective nozzles prior to said part-flows exiting through the slots and being admixed with room air on the supply side of said device.

It will also be evident from FIG. 8 that the fresh air supplied via the terminal device will mix effectively with room air, as a result of the shape and positioning of the slots.

Located between two mutually sequential nozzles 12 of a nozzle module 11 is a partition wall 11*a* which contributes towards directing the colliding part-flows B out through an adjacent slot 7. The ends of the nozzle modules 11 carry spring snap-elements 11*b* for detachably securing a nozzle module to the defining surfaces of the first and the last slot 7 of respective groups 10. These snap-elements 11*b* project into the air flow in the device and equalize any occurrent differences in the flow rate of the main flow.

These snap-elements 11*b* include finger-actuable parts 11c which enable the nozzle modules 11 to be moved sideways.

Figure 9:
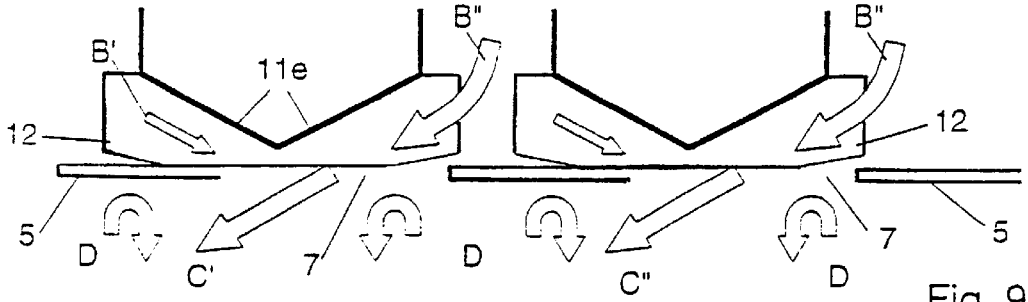
FIG. 9 is a view corresponding to the view of FIG. 8 and shows the nozzle module in a position for lateral deflection of the air flow exiting through the slots.

Sideways movement of the nozzle modules enables the air streams exiting from respective slots 7 to be directed at an angle of ±90° from the perpendicular straight out from the front wall 5, when the nozzle module 11 is located in its central position. FIG. 9 shows the two adjacent nozzles 12 moved to the left, wherewith the air stream B' is partially choked while the air stream on the opposite side increases, as illustrated by the larger arrows B". The exiting air streams C' are herewith deflected to the throttled side.

The occurrent spacing between the two mutually adjacent nozzles 12 in FIGS. 8 and 9 facilitates admixture of the fresh air with room air.

As will be evident from FIGS. 5 and 6, the nozzle modules 11 are comprised of a main body having mutually parallel elements 11*d* on respective sides of the module, and a rear wall 11*e* which includes two parts that project forwards at an angle to one another in front of the side elements. This main body supports the mutually sequential nozzles 12, each of which has a central planar part 12*a* that extends perpendicularly to the side elements 11*d* and projects out forwardly of said elements, and have at the ends thereof mutually opposing curved end-parts which form the deflecting elements 11*a*. The side elements 11*d* are connected between the nozzles 12 with intermediate walls 11*a* which extend parallel with the central planar parts 12*a* of the nozzles. The labyrinth construction of the nozzle modules results in a pronounced reduction in the radiation of noise generated in the ventilation system.

As before mentioned, the deflecting elements 12*b* on respective sequential nozzles 12 in the main flow direction project progressively further out from respective central parts 12*a*.

The slots 7 may have a size of 3×35 mm. The distance between each group 10 of slots 7 may be 20 mm for instance, which affords the room air "free passage" to all ejection openings.

What is claimed is:

1. A box-like or screen-like supply air terminal device comprising:

a main body that includes a top wall (3), a bottom wall (4), and front and back walls, and optionally side walls, that extend between said top and bottom walls, wherein at least a front wall (5) is provided with a plurality of holes or openings (7) through which air delivered to the interior of the device (1) via a connection (8) is supplied to a room or location, and wherein nozzles (12) are provided in the proximity of the holes (7) for capturing and deflecting part-flows (B) that pass through the device in a main flow direction (A), and wherein a) the front wall (5) includes a plurality of groups (10) of slots (7), wherein the slots (7) of one group are situated sequentially in parallel with the main flow direction at a mutual group spacing both in said parallel direction and in a direction perpendicular thereto;

b) each group (10) of slots (7) is allocated to a separate nozzle module (11 ) mounted on the inside of the front wall (5), wherein said nozzle module includes a plurality of the nozzles (12) corresponding to a number of the slots, and wherein the nozzles (12) are adapted to capture and deliver to each slot (7) part-flows (B) of equal magnitudes; and c) each nozzle (12) of the nozzle module (11) is adapted to capture and repeatedly deflect said part-flows (B), namely from the main flow direction perpendicularly thereto in towards the center of the nozzle (12) by virtue of the curvature of two mutually opposing deflecting parts (12*b*) formed on opposing ends of said nozzle, and thereafter deflect the part-flows through a further angle of about 90° as a result of the collision of the part-flows (B) deflected by said deflecting parts, wherewith the part-flows exit outwards through the slot (7) of respective nozzles with a low impulse, and wherein each of the mutually sequential nozzles (12) in the nozzle module (11) has curved deflecting parts (12*b*) that have a progressively increasing area and that project out perpendicularly to the main flow direction.

2. A terminal device according to claim 1, wherein a partition wall (11*a*) is provided between two mutually sequential nozzles (12) in the nozzle module (11), to contribute towards directing the collided part-flows (B) out through the adjacent slot (7) at right angles to the slotted wall (5).

3. A terminal device according to claim 1, wherein the nozzle modules (11) have snap-elements (11*b*) for positioning the nozzle modules off-center with respect to the longitudinal direction of the slots (7).

4. A terminal device according to claim 3, the nozzle modules (11) are positioned off-center towards either end of the slots (7) so as to direct the air streams at an angle of about ±90° in relation to the outflow direction in the central position of said modules.

5. A nozzle module for a supply air terminal device according to claim 1, characterized in that the module includes a) a body structure that has mutually parallel elements (11*d*) extending on the sides of the module;

b) a number of mutually sequential nozzles (12) that have a central planar part (12*a*) which extends perpendicularly to the side elements and projects out forwardly thereof, and that also have mutually opposing curved end-parts that form said deflection parts (12*b*);

c) parallel partition walls (11*a*) that are disposed between the nozzles (12) and that are joined to the side elements (11*d*) and to the central planar part (12*a*) of the nozzles; wherein the curved deflecting parts of the mutually sequential nozzles (12) have progressively increasing areas.

6. A nozzle module according to claim 5, characterized in that the body structure has a rear wall (11*e*) which preferably includes two forwardly projecting parts that are angled to one another forwardly of the side elements (11*d*).

7. A box-like or screen-like air terminal device, comprising:

a main body that includes a top wall (3), a bottom wall (4), and front and back walls, and optionally side walls, that extend between said top and bottom walls, wherein at least a front wall (5) is provided with a plurality of holes or openings (7) through which air delivered to the interior of the device (1) via a connection (8) is supplied to a room or location, and wherein nozzles (12) are provided in the proximity of the holes (7) for capturing and deflecting part-flows (B)

that pass through the device in a main flow direction (A), and wherein a) the front wall (5) includes a plurality of groups (10) of slots (7), wherein the slots (7) of at least one of said plurality of groups are situated sequentially in parallel with the main flow direction at a mutual group spacing both in said parallel direction and in a direction perpendicular thereto;

b) each group (10) of slots (7) is allocated to a nozzle module (11) mounted on the inside of the front wall (5), wherein said nozzle module includes a plurality of the nozzles (12) corresponding to a number of the slots, and wherein the nozzles (12) are adapted to capture and deliver to each slot (7) part-flows (B) of mutually equally magnitudes; and c) each nozzle (12) of the nozzle module (11) is adapted to capture and repeatedly deflect said part-flows (B), namely from the main flow direction perpendicularly thereto in towards the center of the nozzle (12) by virtue of the curvature of two mutually opposing deflecting parts **(12*b*) formed on opposing ends of said nozzle and thereafter deflect the part-flows through a further angle of about 90° as a result of the collision of the part-flows (B) deflected by said deflecting parts, wherewith the part-flows exit outwards through the slot (7) of respective nozzles with a low impulse, wherein the ends of the nozzle modules carry spring snap-elements (11*b*) for detachably securing respective modules in the first and the last slot (7) of at least one of the groups (10)**, and wherein said snap-elements equalize any difference in the rate of flow of said main flow.

8. A terminal device according to claim 7, characterized in that the snap-elements **(11*b*) include finger-actuable parts (11*c*)** by means of which the nozzle modules can be moved sideways.

9. A terminal device according to claim 7, wherein the nozzle modules (11) are connected by plates that extend along the sides of said nozzle modules (11) so that when the modules move sideways, the modules move simultaneously.

10. A box-like or screen-like air terminal device, comprising:

a main body that includes a top wall (3), a bottom wall (4), and front and back walls, and optionally side walls, that extend between said top and bottom walls, wherein at least a front wall (5) is provided with a plurality of holes or openings (7) through which air delivered to the interior of the device (1) via a connection (8) is supplied to a room or location, and wherein nozzles (12) are provided in the proximity of the holes (7) for capturing and deflecting part-flows (B) that pass through the device in a main flow direction (A), and wherein a) the front wall (5) includes a plurality of groups (10) of slots (7), wherein the slots (7) of at least one of said plurality of groups are situated sequentially in parallel with the main flow direction at a mutual group spacing both in said parallel direction and in a direction perpendicular thereto;

b) each group (10) of slots (7) is allocated to a nozzle module (11) mounted on the inside of the front wall (5), wherein said nozzle module includes a plurality of the nozzles (12) corresponding to a number of the slots, and wherein the nozzles (12) are adapted to capture and deliver to each slot (7) part-flows (B) of mutually equally magnitudes; and c) each nozzle (12) of the nozzle module (11) is adapted to capture and repeatedly deflect said part-flows (B), namely from the main flow direction perpendicularly thereto in towards the center of the nozzle (12) by virtue of the curvature of two mutually opposing deflecting parts **(12*b*) formed on opposing ends of said nozzle, and thereafter deflect the part-flows through a further angle of about 90° as a result of the collision of the part-flows (B) deflected by said deflecting parts, wherewith the part-flows exit outwards through the slot (7) of respective nozzles with a low impulse, wherein said nozzle modules have spring snap-elements (11*b*)** on the ends of respective nozzle modules for detachably fitting the nozzle modules to respective slots in the terminal device.

11. A nozzle module according to claim 10, characterized in that the snap-elements **(11*b*) have finger-actuable parts (11*b*)** to facilitate sideways movement of the nozzle modules in respective slots.

* * * * *